US007391416B2

(12) United States Patent
Yearim

(10) Patent No.: US 7,391,416 B2
(45) Date of Patent: Jun. 24, 2008

(54) FINE TUNING A SAMPLING CLOCK OF ANALOG SIGNALS HAVING DIGITAL INFORMATION FOR OPTIMAL DIGITAL DISPLAY

(75) Inventor: Gady Yearim, Haifa (IL)

(73) Assignee: Oplus Technologies, Inc., Yokneam (IL)

( * ) Notice: Subject to any disclaimer, the term of this patent is extended or adjusted under 35 U.S.C. 154(b) by 782 days.

(21) Appl. No.: 10/498,979

(22) PCT Filed: Dec. 26, 2002

(86) PCT No.: PCT/IL02/01043

§ 371 (c)(1),
(2), (4) Date: Jun. 25, 2004

(87) PCT Pub. No.: WO03/060623

PCT Pub. Date: Jul. 24, 2003

(65) Prior Publication Data

US 2005/0020228 A1 Jan. 27, 2005

Related U.S. Application Data

(60) Provisional application No. 60/342,387, filed on Dec. 27, 2001.

(51) Int. Cl.
*G09G 5/00* (2006.01)

(52) U.S. Cl. ..... 345/213; 345/211; 345/212; 345/99; 345/204; 345/690; 348/510; 348/512; 348/513; 348/536; 348/537

(58) Field of Classification Search ..... 345/204, 345/211–213, 690
See application file for complete search history.

(56) References Cited

U.S. PATENT DOCUMENTS

| | | | | |
|---|---|---|---|---|
| 6,097,437 | A | 8/2000 | Hwang | |
| 6,097,444 | A * | 8/2000 | Nakano | 348/607 |
| 6,285,344 | B1 | 9/2001 | Everard et al. | |
| 6,404,422 | B1 * | 6/2002 | Choi | 345/211 |
| 6,833,875 | B1 * | 12/2004 | Yang et al. | 348/665 |

FOREIGN PATENT DOCUMENTS

WO PCT WO 03/060623 7/2003

* cited by examiner

*Primary Examiner*—Richard Hjerpe
*Assistant Examiner*—Jennifer T Nguyen
(74) *Attorney, Agent, or Firm*—Trop, Pruner & Hu, P.C.

(57) ABSTRACT

Method and system for fine tuning frequency and phase of a sampling clock of analog signals (R, G, B) having digital information, for sampling the analog signals within an optimal sampling period, enabling optimal display by a digital display device (92). Small amount of information from input signals is required for rapidly and accurately determining values of frequency and phase of the sampling clock. After measuring using a measurement system (96) and obtaining pixel values while sweeping phase values of signals using a phase locked loop (PLL) mechanism (48), there is determining values of two parameters, (i) error of an initial frequency value of the sampling clock (Rx clock), proportional to error of an initial phase locked loop (PLL) division factor value, and (ii) phase of the sampling clock, without need for making additional measurements based on these values, using a control unit (94).

19 Claims, 5 Drawing Sheets

FINE TUNING A SAMPLING CLOCK OF ANALOG SIGNALS HAVING DIGITAL INFORMATION FOR OPTIMAL DIGITAL DISPLAY

RELATED PATENT APPLICATION

This application is a National Phase Application of PCT/IL02/01043 International Filing Date 26 Dec. 2002, which claims priority from U.S. Provisional Patent Application No. 60/342,387 filed 27 Dec. 2001.

FIELD AND BACKGROUND OF THE INVENTION

The present invention relates to signal processing used in field of electronics, and more particularly, to a method and system for fine tuning a sampling clock of analog signals having digital information for optimal digital display. The method and system are based on fine tuning frequency and phase of a sampling clock of the analog signals, for sampling incoming analog signals having digital information within an optimal sampling period, thereby enabling optimal display by a digital display device.

Currently, most common methods and systems of transmitting computer display information to display devices are based on using analog transmission. For example, the VGA format was originally defined by VESA (Video Electronics Standards Association) and other organizations for the purpose of providing a universal format for transmitting analog signals carrying digital pixel information, from a transmitter, such as a PC (personal computer) graphics card, to an analog display device, as described in "Monitor Timing Specifications, VESA and Industry Standards and Guidelines for Computer Display Monitor Timing, Version 1.0, Revision 0.8, Adoption Date: Sep. 17, 1998", Milpitas, Calif., USA.

FIG. 1 is a block diagram illustrating such an exemplary VGA interface of a transmitter 10 in a typical computer, used in the transmission of analog signals having digital pixel information to a receiver of a display device 12. Image information stored in a frame buffer is transmitted to the receiver of display device 12, by converting digital pixel information stored in the frame buffer to analog pixel information transmitted to the receiver of display device 12 using a digital to analog converter (DAC). In current VGA formats, analog pixel information is transmitted from transmitter 10 to the receiver of display device 12 along three high speed analog transmission lines, marked R (red), G (green) and B (blue), which are the three basic color components of an image.

In addition to analog pixel information, digital synchronization information, known in the art by the terms 'vertical sync' and 'horizontal sync', and indicated in FIG. 1 by the terms 'Vsync' and 'Hsync', is sent out to mark the beginning of each frame, and the beginning of each display line, respectively. Vsync and Hsync are sent along two separate lines (as shown in FIG. 1), composite to a single line, or embedded within the green color component of the analog signal. A transmitter timing clock, referred to in FIG. 1 as 'Tx clock', provides a timing signal featuring a frequency or rate at which digital pixel information is transmitted from transmitter 10 to the receiver of display device 12 by an analog signal. Digital pixel information transmitted along the R, G, and B, analog transmission lines, and the digital synchronization information signals, Hsync and Vsync, are all synchronized to the transmitter timing clock (Tx clock).

Several standard organizations, such as VESA, have defined many different types of display formats and/or standards. Each display format or standard provides the number of active (displayed) pixels and active (displayed) lines, as well as polarity of Vsync and Hsync, pulse width, cycle time, and position of the active displayed information relative to Vsync and Hsync synchronization pulses. Each display format also defines the frequency or rate of the above described transmitter timing clock (Tx clock), as the frequency or rate at which the digital pixel values are read from the frame buffer, converted to analog signal by the three DACs, and subsequently forwarded to the receiver of the display device. The VGA display interface format was originally defined for analog displays, where each one of the three electronic beam guns within the display device is controlled by the associated analog signal forwarded by the VGA interface.

There is currently a transition from using analog display devices to using digital display devices. Due to the existence of extensive and widespread electronic infrastructure, ordinarily, digital display devices are designed and manufactured for operating with the above described digital to analog VGA interface, but their pixel elements need to be fully defined and individually addressed within the digital display device. For example, in an LCD (liquid crystal display) monitor each pixel is an active element controlling light transmission. In a plasma display monitor each pixel element is a light generator. The luminance information for each color component of each pixel is extracted from the same digital to analog VGA interface, by way of analog to digital conversion, such as by using an analog to digital converter device. This extraction method is a very challenging task because it requires automatic detection of the transmission format and reconstruction of the transmitter timing clock (Tx clock), at the digital display device from the incoming analog RGB signals, and the Hsync and Vsync digital synchronization information signal pulses.

FIG. 2 is a close-up view of an exemplary transmitted analog signal 15 having digital information of a single pixel as part of a transmission format of an analog signal, illustrating pixel timing parameters at a receiver of a digital display device. It is well known that during reception of the analog signals featuring pixels having an R, G, or B, component, at a receiver, such as a receiver of a digital display device, the time period of each pixel is composed of a transition time period 20 during which signal level transition occurs, and a stable time period 22 during which pixel sampling occurs. The signal receiver of the digital display device needs to generate, known in the art as reconstruct, parameters of a sampling clock, using a phase locked loop (PLL) mechanism (functioning with hardware and/or software components) locked to the leading edge of Hsync, or, depending upon the particular type of display format or standard, locked to the trailing edge of Hsync. Frequency of the sampling clock usually exhibits an extent or degree of instability, known as 'jitter', shown in FIG. 2 as reconstructed clock phase locked loop (PLL) jitter time periods 28 and 29, which causes the optimal sampling time period 24 to be shorter than the stable time period 22. Sampling analog signals during the reconstructed clock phase locked loop (PLL) jitter time periods 28 and 29, results in less than optimal analog to digital conversion, and subsequently, results in less than optimal display by the digital display device.

There is thus a need for, and it would be highly advantageous to have a method and system for fine tuning a sampling clock of analog signals having digital information for optimal digital display. Moreover, there is a need for such an invention which is readily commercially applicable to essentially any type of electronic system where transmitted analog signals are destined for display by a digital display device.

SUMMARY OF THE INVENTION

The present invention relates to a method and system for fine tuning a sampling clock of analog signals having digital information for optimal digital display. The method and system are based on fine tuning frequency and phase of a sampling clock of the analog signals, for sampling incoming analog signals having digital information within an optimal sampling period, thereby enabling optimal display by a digital display device.

Thus, according to the present invention, there is provided a method for fine tuning a sampling clock of analog signals having digital information for optimal digital display, comprising the steps of: (a) receiving digital synchronization signals of the analog signals and detecting format based on the received digital synchronization signals; (b) setting an initial frequency value of the sampling clock by setting a phase locked loop division factor value equal to a digital horizontal synchronization signal cycle based on the detected format, and setting a phase value of the sampling clock at a phase locked loop mechanism; (c), fine tuning the initial frequency value of the sampling clock by fine tuning the phase locked loop division factor value, and fine tuning the phase value of the sampling clock, for synchronizing the phase locked loop mechanism with an optimal sampling period; (d) sampling the received analog signals having digital information within an optimal sampling period; and (e) receiving and displaying the digital image pixel information by a digital display device.

According to further features in preferred embodiments of the method of the invention described below, the digital synchronization signals are vertical sync and horizontal sync.

According to further features in preferred embodiments of the method of the invention described below, detecting the format is performed by knowing the format a priori.

According to further features in preferred embodiments of the method of the invention described below, detecting the format is performed by measuring values of various parameters of the vertical sync and the horizontal sync signals, and comparing the measured parameter values to corresponding parameter values of known transmission formats stored in a database.

According to further features in preferred embodiments of the method of the invention described below, the phase locked loop mechanism used for generating the sampling clock is selected from the group consisting of (i) a phase locked loop hardware mechanism, featuring operation of a plurality of hardware components and elements, (ii) a phase locked loop software mechanism, featuring operation or execution of a plurality of software computer programs of software instructions or protocols using a suitable computer operating system, and, (iii) an operative combination of (i) and (ii).

According to further features in preferred embodiments of the method of the invention described below, the optimal sampling period is at center of a stable pixel time, given by deducting from a pixel cycle time a pixel transition time and twice a phase jitter of the sampling clock.

According to further features in preferred embodiments of the method of the invention described below, the fine tuning of the phase value of the sampling clock is realized using a phase delay of the horizontal sync at the phase locked loop mechanism.

According to further features in preferred embodiments of the method of the invention described below, step (c) comprises the step of: (i) searching for and identifying transitional pixels within an input image of the analog signals, and determining a phase value at which a pixel break point occurs for each transitional pixel.

According to further features in preferred embodiments of the method of the invention described below, the break point of each transitional pixel defines a singular point within the pixel, having a phase value where value of the pixel starts to change from a stable region of preceding pixel in same horizontal line to a transitional region of the pixel.

According to further features in preferred embodiments of the method of the invention described below, the break point phase value of the pixel value is measured while the phase value is swept to get a curve of the pixel value as a function of the phase value.

According to further features in preferred embodiments of the method of the invention described below, step (c) further comprises the step of: (ii) searching for and identifying a phase value of a break point for each identified transitional pixel of the input image, by sweeping the phase values of the analog signals.

According to further features in preferred embodiments of the method of the invention described below, step (c) further comprises the step of: (iii) determining an error value of the phase locked loop division factor value, the error value being a difference between an actual phase locked loop division factor value and a phase locked loop division factor value matching the initial frequency value of the sampling clock to a frequency value of a transmitter timing clock.

According to further features in preferred embodiments of the method of the invention described below, if there is no unique solution to an error value of the phase locked loop division factor value, there is searching for and identifying additional transitional pixels.

According to further features in preferred embodiments of the method of the invention described below, whereby step (iii) comprises the step of: (1) checking if the error value of the phase locked loop division factor value equals zero, whereby if the phase locked loop division factor value equals zero, there is determining a corrected value of the phase value of the sampling clock.

According to further features in preferred embodiments of the method of the invention described below, whereby step (iii) further comprises the step of: (2) searching for and identifying the error value of the phase locked loop division factor value by searching through an entire range of allowed error values.

According to further features in preferred embodiments of the method of the invention described below, whereby step (iii) further comprises the step of: (3) checking uniqueness of a phase locked loop division factor value.

According to further features in preferred embodiments of the method of the invention described below, whereby step (c) further comprises the step of: (iv) fine tuning the phase value of the sampling clock, if the error value of the phase locked loop division factor value equals zero, and if the error value of the phase locked loop division factor value is not equal to zero, there is fine tuning the phase locked loop phase value based on values of position and phase of the identified transitional pixels.

According to another aspect of the system of the present invention, there is provided a system for fine tuning a sampling clock of analog signals having digital information for optimal digital display, comprising: (a) a receiver for receiving digital synchronization signals of the analog signals and detecting format based on the received digital synchronization signals; (b) a control unit for setting and fine tuning a phase locked loop division factor value and setting a phase value of the sampling clock; (c) a phase locked loop mechanism for generating a sampling signal controlled by the control unit; (d) at least one analog to digital conversion device for sampling the received analog signals having digital information within an optimal sampling period; and (e) a digital display device for receiving and displaying the digital image pixel information by a digital display device.

According to further features in preferred embodiments of the system of the invention described below, the digital synchronization signals are vertical sync and horizontal sync.

According to further features in preferred embodiments of the system of the invention described below, detecting the format is performed by knowing the format a priori.

According to further features in preferred embodiments of the system of the invention described below, detecting the format is performed by measuring values of various parameters of the vertical sync and the horizontal sync signals, and comparing the measured parameter values to corresponding parameter values of known transmission formats stored in a database.

According to further features in preferred embodiments of the system of the invention described below, the phase locked loop mechanism used for generating the sampling clock is selected from the group consisting of (i) a phase locked loop hardware mechanism, featuring operation of a plurality of hardware components and elements, (ii) a phase locked loop software mechanism, featuring operation or execution of a plurality of software computer programs of software instructions or protocols using a suitable computer operating system, and, (iii) an operative combination of (i) and (ii).

According to further features in preferred embodiments of the system of the invention described below, the optimal sampling period is at center of a stable pixel time, given by deducting from a pixel cycle time a pixel transition time and twice a phase jitter of the sampling clock.

According to further features in preferred embodiments of the system of the invention described below, the fine tuning of the phase value of the sampling clock is realized using a phase delay of the horizontal sync at the phase locked loop mechanism.

Implementation of the method and system for fine tuning a sampling clock of analog signals having digital information for optimal digital display of the present invention involves performing or completing selected tasks or steps manually, semi-automatically, fully automatically, and/or a combination thereof. Moreover, according to actual instrumentation and/or equipment used for implementing a particular preferred embodiment of the disclosed method and system, several selected steps of the present invention could be performed by hardware, by software on any operating system of any firmware, or a combination thereof. In particular, as hardware, selected steps of the invention could be performed by a computerized network, a computer, a computer chip, an electronic circuit, hard-wired circuitry, or a combination thereof, involving a plurality of digital and/or analog, electrical and/or electronic, components, operations, and protocols. Additionally, or alternatively, as software, selected steps of the invention could be performed by a data processor, such as a computing platform, executing a plurality of computer program types of software instructions or protocols using any suitable computer operating system.

BRIEF DESCRIPTION OF THE DRAWINGS

The present invention is herein described, by way of example only, with reference to the accompanying drawings. With specific reference now to the drawings in detail, it is stressed that the particulars shown are by way of example and for purposes of illustrative description of the preferred embodiments of the present invention only, and are presented in the cause of providing what is believed to be the most useful and readily understood description of the principles and conceptual aspects of the present invention. In this regard, no attempt is made to show structural details of the present invention in more detail than is necessary for a fundamental understanding of the invention, the description taken with the drawings making apparent to those skilled in the art how the several forms of the invention may be embodied in practice. In the drawings.

DESCRIPTION OF THE PREFERRED EMBODIMENTS

Figure 1:
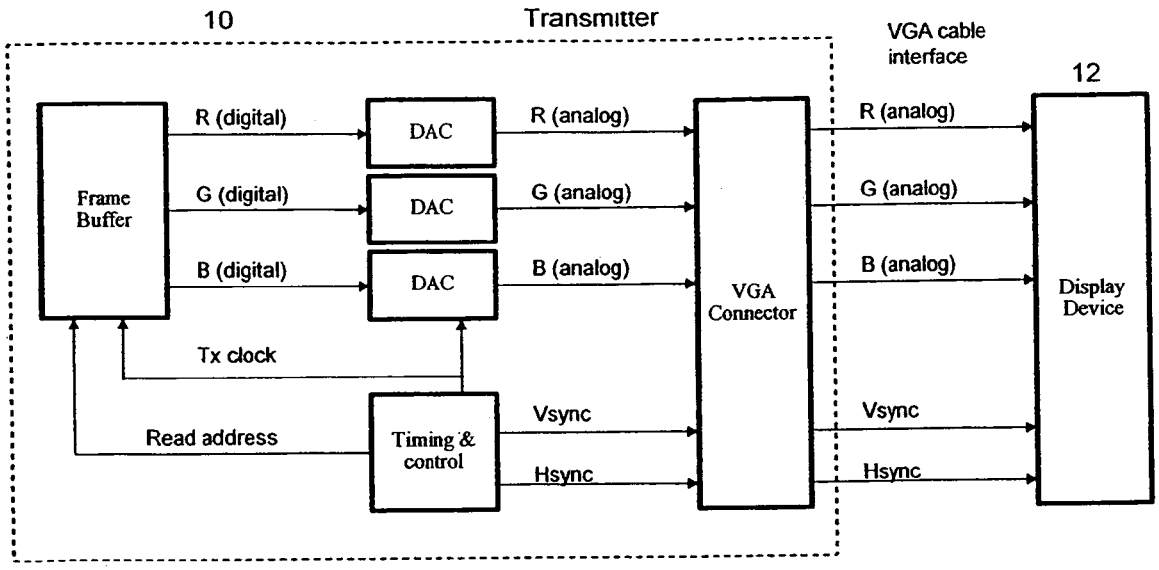
FIG. 1 (PRIOR ART)
FIG. 1 is a block diagram illustrating an exemplary VGA interface of a transmitter in a typical computer, used in the transmission of analog signals having digital pixel information to a receiver of a display device.

The present invention relates to a method and system for fine tuning a sampling clock of analog signals having digital information for optimal digital display. The method and system are based on fine tuning frequency and phase of a sampling clock of the analog signals, for sampling incoming analog signals having digital information within an optimal sampling period, thereby enabling optimal display by a digital display device.

A main aspect of novelty and inventiveness of the method and system of the present invention is whereby a relatively small amount of information from input signals is required for rapidly and accurately determining values of the frequency and phase of a sampling clock. More specifically, after measuring and obtaining pixel values while sweeping the phase values of signals using a phase locked loop (PLL) mechanism (functioning with hardware and/or software components), the method and system of the present invention determine values of two parameters, (i) error of an initial frequency value of the sampling clock, herein, also referred to as 'Rx clock', being proportional to error value of an initial phase locked loop (PLL) division factor value, and (ii) phase of the sampling clock (Rx clock), without need for making additional measurements based on values of these two parameters.

The method and system of the present invention for fine tuning a sampling clock of analog signals having digital information, in general, and having standard video image information, in particular, for optimal digital display, are independent of the type of analog signal transmitter, as long as there is proper identification of the analog transmission format. Furthermore, implementing the present invention maintains high image quality by not requiring use of a low-pass filter on input signals.

Based upon the above indicated aspects of novelty, inventiveness, and advantages, the present invention successfully overcomes shortcomings, and widens the scope, of presently known methods and systems of processing analog signals having digital information for digital display, for example, which are based on maximizing pixel differences or minimizing signal noise. Moreover, the method and system of the present invention are commercially applicable to essentially any type of electronic setup where transmitted analog signals are destined for display by a digital display device.

It is to be understood that the present invention is not limited in its application to the details of the order or sequence of steps of operation or implementation of the method, or to the details of type, composition, construction, arrangement, and order, of the components and elements of the system, set forth in the following description and accompanying drawings. The present invention is capable of other embodiments or of being practiced or carried out in various ways. Although steps and components similar or equivalent to those described herein can be used for practicing or testing the present invention, suitable steps and components are described herein.

It is also to be understood that unless otherwise defined, all technical and scientific words, terms, and/or phrases, used herein have the same meaning as commonly understood by one of ordinary skill in the art to which this invention belongs. Phraseology, terminology, and, notation, employed herein are for the purpose of description and should not be regarded as limiting. For example, the following description refers to the use of a phase locked loop (PLL) mechanism (functioning with hardware and/or software components), in order to illustrate implementation of the present invention. It is to be fully understood, as is well known in the art of signal processing, that the phase locked loop (PLL) mechanism refers to (i) a phase locked loop (PLL) 'hardware' mechanism, featuring operation of a plurality of hardware components and elements, or (ii) a phase locked loop (PLL) 'software' mechanism, featuring operation or execution of a plurality of software computer programs of software instructions, algorithms, or protocols, using a suitable computer operating system, or (iii) an operative combination of (i) and (ii).

Steps, components, operation, and implementation of a method and system for fine tuning a sampling clock of analog signals having digital information for optimal digital display, according to the present invention, are better understood with reference to the following description and accompanying drawings. Throughout the following description and accompanying drawings, like reference numbers refer to like components or elements.

In the following description of the method and system of the present invention, included are main or principal steps and sub-steps, and main or principal devices, mechanisms, components, and elements, needed for sufficiently understanding proper 'enabling' utilization and implementation of the disclosed method and system. Accordingly, description of various possible required and/or optional preliminary, intermediate, minor, steps, sub-steps, devices, mechanisms, components, and/or elements, which are readily known by one of ordinary skill in the art, and/or which are available in the prior art and technical literature relating to signal processing, are at most only briefly indicated herein. For example, with reference to FIG. 1, the following description of the method and system of the present invention focuses on that part of signal processing performed between the VGA connector and a 'digital' type of display device 12, even though signal processing also takes place before and after these components.

In Step (a) of implementing the method and system for fine tuning a sampling clock of analog signals having digital information for optimal digital display, there is receiving digital synchronization signals of the analog signals and detecting the format based on the received digital synchronization signals.

Again referring to FIG. 1, a block diagram illustrating an exemplary VGA interface of a transmitter 10 in a typical computer, used in the transmission of analog signals having digital pixel information to a receiver of a display device 12, where, hereinafter, for describing the method and system of the present invention, display device 12 is a 'digital' type of display device, and is referred to as digital display device 12. Image information stored in a frame buffer is transmitted to the receiver of digital display device 12, by converting digital pixel information stored in the frame buffer to analog pixel information transmitted to the receiver of digital display device 12 using a digital to analog converter (DAC). In current VGA formats, analog pixel information is transmitted from transmitter 10 to the receiver of digital display device 12 along three high speed analog transmission lines, marked R (red), G (green) and B (blue), which are the three basic color components of an image.

In addition to analog pixel information, digital synchronization signals, known in the art by the terms 'vertical sync' and 'horizontal sync', and indicated in FIG. 1 by the terms 'Vsync' and 'Hsync', is sent out to mark the beginning of each frame, and the beginning of each display line, respectively. Vsync and Hsync are sent along two separate lines (as shown in FIG. 1), composite to a single line, or embedded within the green color component of the analog signal. A transmitter timing clock, referred to in FIG. 1 as 'Tx clock', provides a timing signal featuring a frequency or rate at which digital pixel information is transmitted from transmitter 10 to the receiver of digital display device 12 by an analog signal. Digital pixel information transmitted along the R, G, and B, analog transmission lines, and the digital synchronization information signals, Hsync and Vsync, are all synchronized to the transmitter timing clock (Tx clock).

Detecting the format based on the received digital synchronization signals, Vsync and Hsync, is performed by either knowing the format a priori, or by measuring values of various parameters of the Vsync and Hsync signal pulses, and comparing these measured parameter values to corresponding parameter values of known transmission formats stored in a database, for example, involving use of look-up-tables, as is known in the art.

Figure 2:
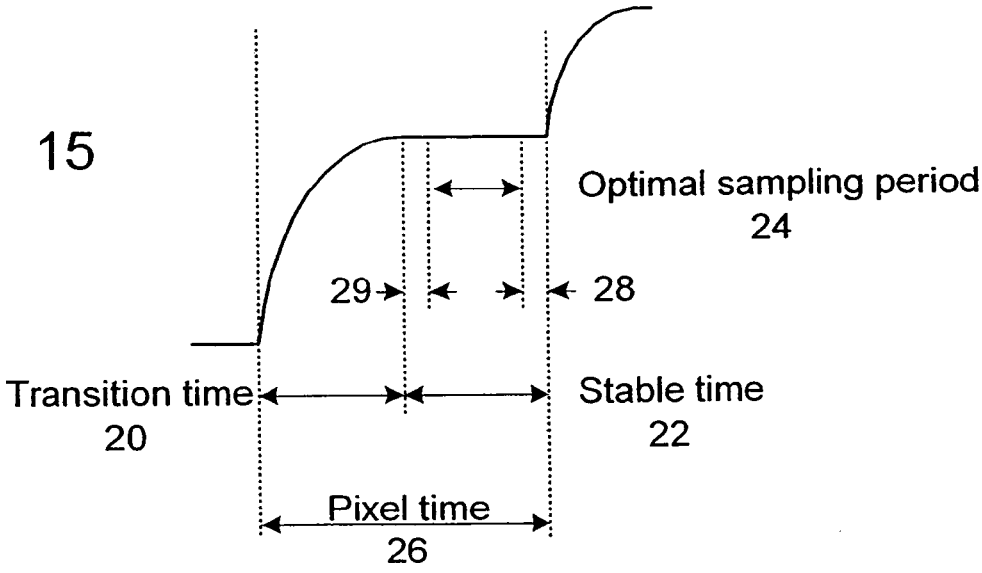
FIG. 2 (PRIOR ART)
FIG. 2 is a close-up view of an exemplary transmitted analog signal having digital information of a single pixel as part of a transmission format of an analog signal, illustrating pixel timing parameters at a receiver of a digital display device.
Figure 3:
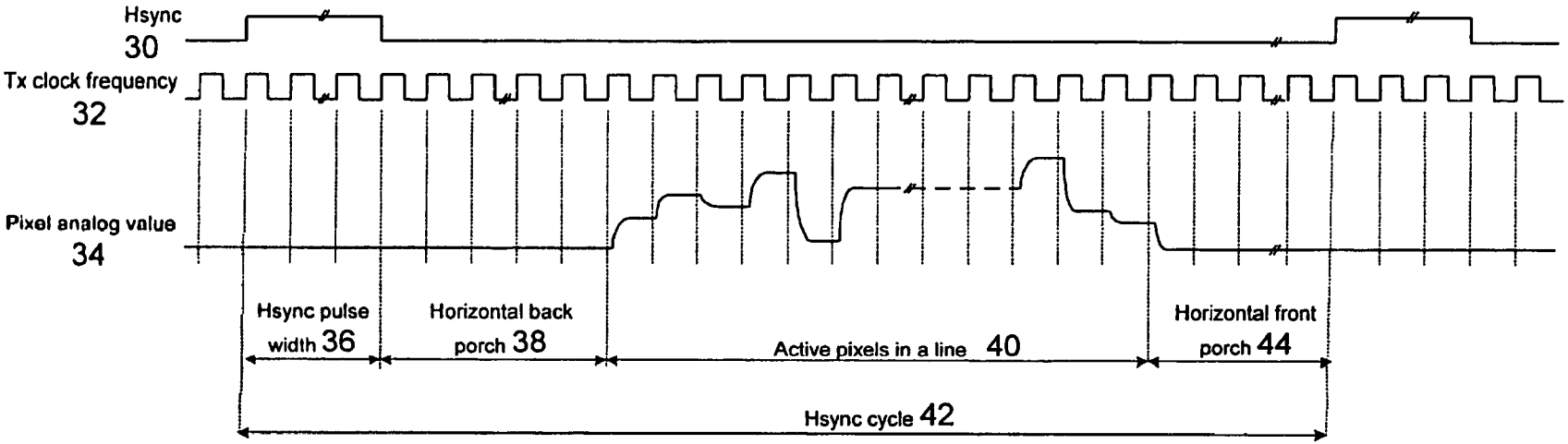
FIG. 3 is a schematic diagram illustrating an exemplary transmitted analog signal of a single display line, and parameters thereof, as a function of time, according to the transmission format partly illustrated in FIG. 2.

FIG. 3 is a schematic diagram illustrating an exemplary transmitted analog signal 34. and parameters thereof, as a function of time, according to the transmission format partly illustrated in previously described FIG. 2, a close-up view of an exemplary transmitted analog signal 15 having digital information of a single pixel as part of a transmission format of an analog signal, illustrating pixel timing parameters at a receiver of a digital display device. With reference to FIG. 3, the VESA monitor timing specifications standard defines several parameters of transmitted analog signals as follows:

Hsync 30: digital horizontal synchronization signal.

Vsync (not shown in FIG. 3): digital vertical synchronization signal.

Tx clock frequency 32: frequency of the transmitter timing clock (Tx clock), also referred to as transmitted pixel clock frequency, in terms of number of pixels per unit time.

Hsync pulse width 36: in terms of number of pixels, and polarity thereof.

Vsync pulse width (not shown in FIG. 3): in terms of number of lines, and polarity thereof.

Horizontal back porch 38: number of blank pixels from end of Hsync pulse to first active pixel.

Vertical back porch (not shown in FIG. 3): number of blank lines from end of Vsync pulse to first active line.

Active pixels in a line 40: also referred to as pixel resolution.

Active lines in a frame (not shown in FIG. 3): also referred to as line resolution.

Hsync cycle 42: representing total number of horizontal pixels in a single Hsync cycle. This parameter is used for setting an initial value of a phase locked loop (PLL) division factor of the analog signal sampling clock (Rx clock), as described in detail in Step (b).

Vsync cycle (not shown in FIG. 3): representing total number of lines in a single Vsync cycle, or in a single frame.

Refresh rate: Vsync frequency=pixel clock frequency/(Hsync cycle X Vsync cycle).

Typically, measured values of a sub-set of the above list of parameters of transmitted digital synchronization signals, Vsync and Hsync, are used for detecting the format of the received image of the analog signals having digital pixel information. For example, pulse width, pulse cycle, and pulse polarity, of each of the Hsync and Vsync signals, whereby pulse polarity is determined according to whether the particular digital synchronization signal is sent with active high or active low.

In Step (b), there is setting an initial frequency value of the sampling clock (Rx clock) by setting a phase locked loop (PLL) division factor value equal to Hsync cycle based on the detected format, and setting a phase value of the sampling clock (Rx clock), at a phase locked loop (PLL) mechanism.

Information and data obtained in Step (a) for detecting the format of the transmitted analog signals are used for performing Step (b), whereby frequency of the sampling clock (Rx clock) is estimated. It is to be understood that although the transmitter 'knows' the frequency of the transmitter clock (Tx clock), this frequency is usually not transmitted. Initial phase value is set to an arbitrary value.

Figure 4:
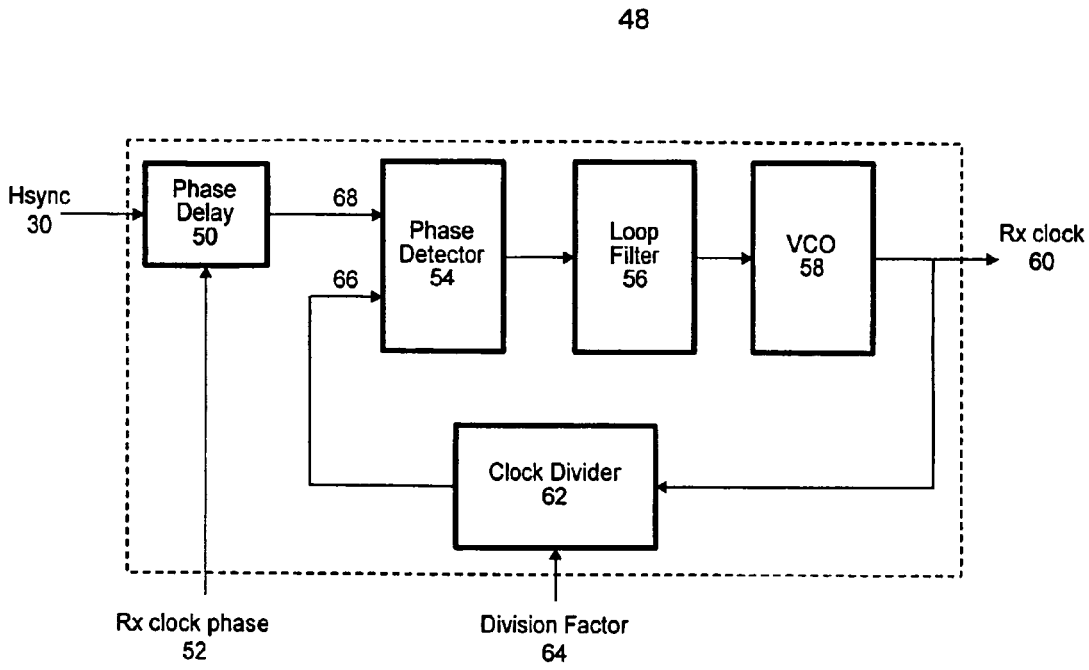
FIG. 4 is a block diagram illustrating an exemplary preferred embodiment of a phase locked loop (PLL) mechanism (functioning with hardware and/or software components), used for generating a sampling clock (Rx clock) locked to received Hsync, in accordance with the present invention.

The sampling clock (Rx clock) is generated using a phase locked loop (PLL) mechanism, whereby the initial frequency value of the sampling clock (Rx clock) is set equal to the frequency value of Hsync multiplied by Hsync cycle (which is equal to the phase locked loop (PLL) division factor value). FIG. 4 is a block diagram illustrating an exemplary preferred embodiment of a phase locked loop (PLL) mechanism (functioning with hardware and/or software components), generally indicated by the dashed line enclosure and referred to as phase locked loop (PLL) mechanism 48. Phase locked loop (PLL) mechanism 48, used for generating sampling clock (Rx clock) 60, is selected from the group consisting of (i) a phase locked loop (PLL) 'hardware' mechanism, featuring operation of a plurality of hardware components and elements, (ii) a phase locked loop (PLL) 'software' mechanism, featuring operation or execution of a plurality of software computer programs of software instructions or protocols using a suitable computer operating system, and, (iii) an operative combination of (i) and (ii).

As shown in FIG. 4, Hsync 30 is operatively input to phase detector 54 following a phase delay 50. Phase detector 54 compares input signals 68 and 66. Output signal of phase detector 54 is proportional to the phase difference between input signals 68 and 66. Loop filter 56 is a low pass filter, filtering the output signal of phase detector 54 and providing a clear and stable DC voltage level to a voltage controlled oscillator (VCO) 58. Voltage controlled oscillator (VCO) 58 generates sampling clock (Rx clock) 60. Initial frequency value of sampling clock (Rx clock) 60 generated by phase locked loop (PLL) mechanism 48 equals Hsync frequency value multiplied by an initial phase locked loop (PLL) division factor value 64.

Sampling clock (Rx clock) 60 is divided by initial phase locked loop (PLL) division factor value 64 by a clock divider 62. Output signal 66 of clock divider 62, corresponding to an estimated number of total horizontal pixels in a single Hsync cycle, is sent to a feedback input of phase detector 54. Phase locked loop (PLL) division factor value 64 is initially set with the value of Hsync cycle 42 (FIG. 3) obtained from definition of the transmitted format of the received digital synchronization signals, which was detected according to previously described Step (a).

In Step (c), there is fine tuning the frequency value of the sampling clock (Rx clock), by fine tuning the phase locked loop (PLL) division factor value, and fine tuning the phase value of the sampling clock (Rx clock), for synchronizing the phase locked loop (PLL) mechanism with an optimal sampling period.

As previously described in preceding Step (b), the Hsync frequency value and the initial phase locked loop (PLL) division factor value are used for setting the initial frequency value of the sampling clock (Rx clock). The initial phase locked loop (PLL) division factor value should be equal to Hsync cycle determined in Step (a) for proper pixel sampling. Fine tuning, by correcting, the initial phase locked loop (PLL) division factor value is sometimes required when the graphics card at the transmitter is not producing exact Hsync cycle as expected by the display device at the receiver. For example, if standard value of Hsync cycle is not exactly kept at the PC display card, fine tuning is required to find the actual value of Hsync cycle, and load it to the phase locked loop (PLL) mechanism as a division factor value.

If the initial phase locked loop (PLL) division factor value is not making the frequency of the sampling clock matching the frequency clock at the transmitter (that is, frequency of the transmitter timing clock (Tx clock) is not exactly equal to frequency of the sampling clock (Rx clock), the sampling point within each pixel will vary along the display horizontal line. As a result, it will be impossible to sample all pixels at their optimum sampling point (24 in FIG. 2), and therefore, fine tuning of the initial phase locked loop (PLL) division factor value is required.

Figure 5:
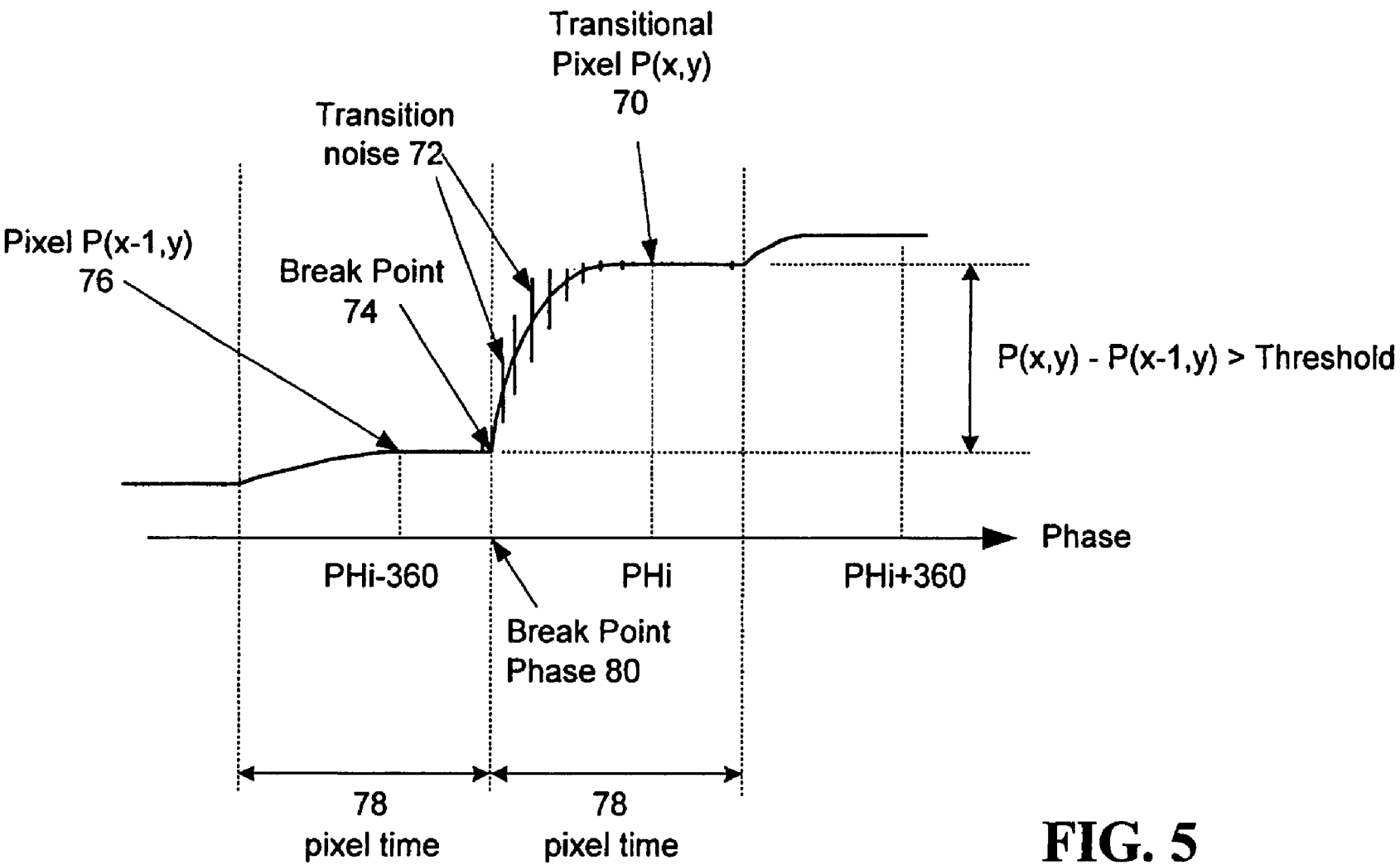
FIG. 5 is a schematic diagram illustrating an exemplary preferred embodiment of sampling a transitional pixel as a function of phase, in accordance with the present invention.

Referring to FIG. 5, a schematic diagram illustrating an exemplary preferred embodiment of sampling a transitional pixel as a function of phase, when pixels are sampled at the pixel transition time 20 (FIG. 2), instability in pixel sampling value is noticed due to phase locked loop (PLL) jitter. In most cases, transition noise 72 is a result of the phase locked loop (PLL) jitter. The sampling clock (Rx clock) frequency instability is seen as noise, and the displayed image is seen with vertical bars of noise stripes. The number of noise stripes is equal to the error of the initial phase locked loop (PLL) division factor value. The error value of the initial phase locked loop (PLL) division factor value is the difference between the estimated value of Hsync cycle at the receiver and the value of Hsync cycle at the transmitter.

After adjusting phase locked loop (PLL) division factor value, fine-tuning of the phase is required to guarantee sampling of the analog incoming RGB signals at the optimum sampling period 24. As stated above, there is synchronizing the phase locked loop (PLL) mechanism with an optimal sampling period. The optimal sampling period, is at the center of the stable pixel time, given by deducting from pixel cycle time the pixel transition time and twice the phase jitter of Rx clock. The reason for deducting twice the phase jitter is that the diversion can be to the right or to the left. In the preferred embodiment of the present invention, fine tuning of the phase value of the sampling clock (indicated as Rx clock phase 52 in FIG. 4) is realized using Hsync phase delay 50 at the phase locked loop (PLL) mechanism 48 as seen in FIG. 4. Increasing the phase delay is delaying Hsync signal, result in delaying the sampling point (or moving the sampling point to the right).

The phase delay (noted as Rx clock phase 52 at FIG. 4) is measured in degrees, where 0° means no delay, and 360° means one Rx clock cycle delay. In many phase locked loop (PLL) mechanisms or devices, the phase resolution is more than 1° (for example: in 32 step resolution, (360/32)=11.25° each step), however, for clarity reasons and without limiting the scope of the present invention, a 1° resolution phase unit is used throughout this description.

The following description of sub-steps (i)-(iv) of Step (c) includes detailed description of the preferred embodiment of the just described fine tuning of phase locked loop (PLL) division factor value and fine tuning of phase locked loop (PLL) Rx clock phase. Before start describing those steps, few formal definitions of the problem are to be defined, few observations that are used in the synthesis and analysis of the method and system disclosed in the preferred embodiment of the present invention are to be discussed, and a common location inside the pixel time called 'Break point' is to be defined for all of the 'Transitional pixels'.

The following definitions are used for defining the following steps more formally and clearly:

'Hsync_cycle' as defined hereinafter is the estimated number of Rx clock cycles within one horizontal line. This estimation is based on step (a) disclosed above. Rx clock is sometimes shortly written as "clock" hereinafter. The Hsync_cycle is used for the phase locked loop (PLL) division factor value.

'Real_Hsync_cycle' as defined hereinafter is the number of Tx clock cycles within one horizontal line. The goal of the fine tuning procedure is tuning Hsync_cycle to be equal to Real_Hsync_cycle.

'Delta_HC' as defined hereinafter is equal to Hsync_cycle−Real_Hsync_cycle, and is referred to as 'error value of the initial phase locked loop (PLL) division factor value'. Delta_HC can be positive or negative, for Hsync_cycle greater than or less than Real_Hsync_cycle, respectively.

'Maximum_Delta_HC' as defined hereinafter is an assumption on the maximum value of absolute delta_HC, used in the described method and system.

'Phase delay setup' as defined hereinafter is equal to Rx clock phase 52 in degrees and is sometimes shortly written as 'phase' hereinafter. The phase delay is accomplished by delaying Hsync at the phase locked loop (PLL) input. Phase increase from 0° to 360° results in moving the sampling point one clock cycle to the right on the time axis. 0° corresponds to no delay and 360° corresponds to one Rx clock delay.

'Coordinate system (x,y)' as defined hereinafter, contains two parameters. 'x' defines horizontal pixel position in Rx clock. x=0 at Hsync leading edge. 'y' defines vertical pixel position in lines. y=0 at first line after Vsync rising edge (or falling edge, as decided by the preferred embodiment).

'P(x,y)' as defined hereinafter, is the pixel measured value at position (x,y). The value can be the pixel luminance value or pixel color component intensity value. The color component can be any selected one, with preference to the Green color component.

'Transitional pixel' as defined hereinafter, is a pixel that the difference between its value and its predecessor pixel value is greater than a predefined threshold.

P(x,y) is a transitional pixel if:

$$[P(x,y)-P(x-1,y)]>\text{threshold}$$

When the characteristic (pixel value) of rising edge is equal to the characteristic of the falling edge, both positive and negative transitions can be used for defining a transitional pixel. In that case, P(x,y) is a transitional pixel if:

$$ABS[P(x,y)-P(x-1,y)]>\text{threshold}$$

where 'ABS' is an abbreviation of 'Absolute value of . . . '

After defining the aforementioned definitions, main objects of the present invention are formulated as follows:

Frequency fine tuning: finding Delta_HC, so Hsync_cycle value can be corrected to be equal to Real_Hsync_cycle value.

Phase fine-tuning: correcting the Phase of the sampling clock at the receiver such that the sampling of all pixels be done at the optimal sampling period of the pixels, as defined in FIG. 2.

The following observations are used in the synthesis and analysis of the preferred embodiment of the method and system for fine tuning a sampling clock of analog signals having digital information for optimal digital display:

When Delta_HC is not equal to zero, vertical noise stripes are noticed at transitional pixels. The number of vertical noise stripes is equal to ABS(Delta_HC), and the vertical noise stripes are evenly separated along the display total width. The total width includes active and blanking intervals and therefore there may be cases where not all the vertical noise stripes are noticed on the displayed image due to the fact that some of the vertical noise stripes may be located in the blank area. The horizontal distance between two adjacent vertical noise stripes (in pixels, or in clocks) is equal to:

$$\text{stripe_distance}=\text{Hsync_cycle}/ABS\,(\text{Delta_}HC)$$

Noise stripes are noticed only in transitional pixels. Wherever the image is constant, the stripes are not noticed.

When Delta_HC equal to zero, the image is seen correctly when all pixels are sampled at their optimal sampling period, or is seen as a very noisy image when the sampling points are located in the pixel transition time, assuming image is not completely constant.

When Delta_HC is not equal to zero, and noise stripes are noticed, changing phase delay results in all stripes moving in horizontal direction, keeping stripe distance unchanged.

If Delta_HC>0, while increasing the phase delay stripes are moving to the right (or positive) direction. If Delta_HC<0, while increasing the phase delay stripes are moving to the left (or negative) direction.

The Phase delay 50 has a cycle of 360°. The meaning is that when Delta_HC is not equal to zero, and noise stripes are noticed, increasing phase delay from phase 0° to phase 360° results in stripes moving 'stripe distance' in horizontal direction. Stripe distance is defined in (1) above, in clocks (or pixels).

As part of the present invention, an exemplary preferred embodiment for acquiring specific location inside the pixel time is described herein below, where that specific location featuring, for all of the 'transitional pixels' defined above, a common location inside the pixel time. This common location, for all of the transitional pixels inside the pixel time, always appears at the same location in relation to the starting point of the pixel and is noted hereinafter as 'singular point'. The pixel break point (defined hereinafter) may be used as singular point.

The preferred embodiment of the method and system for fine tuning a sampling clock of analog signals having digital information for optimal digital display features identifying transitional pixels within an input image, and for each transitional pixel determining the phase value at which pixel break point occurs. Transitional pixel identification is done with a constant phase, noted as 'PHi'. PHi phase can be arbitrary chosen, as long as it is fixed alone the acquisition phase.

Referring to FIG. 5, The Pixel Time 78 is the cycle time of one pixel. Inside the cycle time we may define transitional pixel 70 including a break point 74. The break point itself may be a singular point too. The following description is only an example for acquiring singular points. It is possible to choose other criterions for singular points that perform the same tasks.

The break point 74 of each transitional pixel 70 P(x,y) is defining the singular point within the pixel. As stated before, there may be other singular points within the pixel that can be used for the same purpose. The following description, using break point as the singular point, does not limit the scope of the solution.

The break point of pixel P(x,y) is defined hereinafter as a phase value 80 where the pixel value start to change from the stable region of the preceding pixel in the same horizontal line, P(x−1,y), to the transitional region of pixel P(x,y), as seen in FIG. 5. In other words, the break point is defined as the phase value at the beginning of the transitional pixel P(x,y). From hereinafter, any reference to a break point is equivalent to a singular point.

The 'Phase error value' (or 'PH_Error') is defined as the maximum absolute measured error value of the phase at the singular point. The phase error value is a function of the measurement system and the phase locked loop (PLL) jitter.

To find the break point phase 80, the pixel value P(x,y) is measured while the phase value is swept to get the curve of pixel value as a function of phase value. The phase sweep should make sure the break point phase is included in the sweep. It is noted that sampling of P(x,y) at phase 0° is the same as sampling P(x−1,y) at phase 360°.

FIG. 5 shows by the vertical bars 72 that repetitive sampling during the pixel transition noise time 72 results in different values for P(x,y). The sampling clock jitter and uncertainty during the sample and hold time in the ADC (analog to digital converter) usually cause the transition noise 72. A low pass filter (for example, an FIR filter) is applied on the sampling points for producing a smooth curve.

The break point phase value is searched for on the smooth curve. The difference between the true phase value of the break point and the measured phase value of the break point found from the smooth curve is equal to the break point phase error value.

The following sub-steps (i)-(iv) of Step (c) feature detailed description of the preferred embodiment for fine tuning the phase locked loop (PLL) division factor value and fine tuning the phase locked loop (PLL) Rx clock phase.

In sub-step (i) of Step (c), there is searching for and identifying transitional pixels within an input image of the analog signals.

Set phase value equal to an arbitrary phase value (PHi), and search for T+1 transitional pixels within the input image (transitional pixel was defined previously).

Mark the transitional pixels as follows: Pi(xi,yi), i=0, 1, 2, . . . , T

Order the transitional pixels according to their horizontal position: xi>xi−1 for i=1, 2, . . . T. The minimum horizontal difference between two adjacent transitional pixels, Pi(xi,yi) and Pj(xj,yj) where j=i−1, should be greater than (PH_Error/360°) multiplied by Minimum_Stripe_width, where Minimum_Stripe_Width is defined as Hsync_cycle/Maximum_Delta_HC, (PH_Error was defined previously). Transitional pixels that do not fulfill this requirement are removed from the list.

As the number of transitional pixels T+1 is increased, the probability to find unique Delta_HC is increased too. If there is no unique solution to Delta_HC in sub-step (2) of sub-step (iii), there is searching for and identifying additional transitional pixels.

It is explained in sub-step (3) of sub-step (iii), that it is also possible to find out if a given set of transitional pixels is capable of providing a unique solution to Delta_HC, or there is a need to add additional transitional pixels.

In sub-step (ii) of Step (c), there is searching for and identifying a phase value of a break point for each identified transitional pixel of the input image, by sweeping phase values of the analog signals.

For each transitional pixel find the singular point phase value. Without loosing generality, the singular point is defined here as the break point, although other points within the transitional pixel may be used. One way of finding transitional pixel break point phase value is by performing a phase sweep on phase delay 50, that includes the break point, measure the pixel value at each phase value, perform low pass filtering (for example FIR filter) on the measured values in order to obtain a smooth curve, and find the phase value where the break point occurs.

The break point phase of transitional pixel Pi(x,y) is marked hereinafter with PHi. The maximum absolute phase error value is marked hereinafter as PH_Error.

In sub-step (iii) of Step (c), there is determining an error value of the initial phase locked loop (PLL) division factor value.

The purpose of this step is to find the error value of the initial phase locked loop (PLL) division factor value, which was defined as the difference between the actual phase locked loop (PLL) initial division factor value (Hsync_Cycle) and the phase locked loop (PLL) division factor value that matches the Rx clock frequency to the transmitter timing clock (Tx clock) frequency value (defined previously as Real_Hsync_Cycle).

Horizontal difference and phase difference for each pair of transitional pixels (Pi, Pj), where i=1, 2, . . . T, and j<i , are defined as follows:

1) dxij is the horizontal difference between Pi(xi, yi) and Pj(xj, yj), $$dxij=xi-xj,\ i=1, 2, \ldots T, \text{ and } j=0, \ldots, i-1$$

dxij is always a positive number because in sub-step (i) of Step (c) the transitional pixels were organized in incremental order (If i>j than xi>xj).

2) dPHij is the phase difference between Pi(xi, yi) and Pj(xj, yj) modulo 360°, dPHij=(PHi−PHj) modulo 360°.

Modulo 360° operator guarantee that the result (noted here as dPHij) is in the range of 0° to 359°. This is done by adding N×360° if the result is outside the range, where N is the integer number that brings dPHij to the required range.

ABS(Phase) is defined hereinafter as an operator that return the phase distance relative to 0° or 360°, whichever is closer.

$$ABS(\text{Phase})=\text{Phase WHEN Phase}\leqq 180°,\ \text{ELSE } 360°-\text{Phase}$$

In sub-step (1) of sub-step (iii), there is checking if the error value of the initial phase locked loop (PLL) division factor value equals zero.

If for each pair of transitional pixels (Pi, Pj) as defined above, the value of ABS(dPHij) is less than or equal to 2×PH_Error, then there is no error of the initial phase locked loop (PLL) division factor value, and Delta_HC=0. The value of ABS(dPHij) is compared to twice PH_Error is because PHi and PHj measured error values may be of opposite signs.

If the error value of the initial phase locked loop (PLL) division factor value equals 0, jump to sub-step (iv) of step (c)—determining a corrected value of the phase of the sampling clock, Rx clock, of the digital synchronization signals. Otherwise, continue to the next sub-step.

In sub-step (2) of sub-step (iii), there is searching for and identifying the error value of the initial phase locked loop (PLL) division factor value.

The error value of the initial phase locked loop (PLL) division factor value, Delta_HC, is found by a search procedure through the entire range of allowed Delta_HC, from −Maximun_Delta_HC to +Maximum_Delta_HC. The search procedure is terminating correctly if it finds the Delta_HC, which is the correct error value of the initial phase locked loop (PLL) division factor value, and this value is unique (no multiple Delta_HCs).

The following values are defined for sub-step (2) of sub-step (iii) search procedure:

The search index for the absolute value of the error value of the initial phase locked loop (PLL) division factor value is marked by dHC.

The horizontal distance in Rx clock cycles between two adjacent vertical noise stripes is marked as Stripe_distance and is defined as:

$$\text{Stripe_distance}=\text{Hsync_cycle}/dHC$$

For each pair of transitional pixels (Pi,Pj) with horizontal difference dxij and phase difference dPHij, dxij_corrected is defined as:

$$dxij_\text{corrected}=dxij \text{ modulo stripe_distance}$$

where the modulo function guarantee that the result is in the range of 0 to stripe_distance−1. The modulo operation is done by subtracting N×stripe_distance from dxij, where N is a natural number (0, 1, 2, . . . ) that brings the result to the required range.

This step for finding Delta_HC (error value of the initial phase locked loop (PLL) division factor value) is based on the fact that at the correct positive Delta_HC for all pairs of transitional pixels (Pi, Pj), the ratio of $dx_{ij}$_corrected to Stripe_width is equal to the ratio of $dPH_{ij}$ to 360°, and at the correct negative Delta_HC for all pairs of transitional pixels (Pi, Pj), the ratio of $dx_{ij}$_corrected to Stripe_width is equal to one minus the ratio of $dPH_{ij}$ to 360°. The comparison should take into account the phase measured error value for $dPH_{ij}$, which is 2×PH_Error. In formal writing:

FOR each dHC in the range of 1 to Maximum_Delta_HC do the following [1] and [2]:

[1] If for all pairs of transitional pixels (Pi,Pj) as defined above the following relation holds:

$$ABS\ \{[360°\times(dx_{ij}_\text{corrected}/\text{Stripe_distance})-dPH_{ij}] \text{ modulo } 360°\}\leqq 2\times PH_\text{Error Than Delta}_HC=+dHC$$

[2] If for all pairs of transitional pixels (Pi,Pj) as defined above the following relation holds:

$$ABS\ \{[360°\times(dx_{ij}_\text{corrected}/\text{Stripe_distance})+dPH_{ij}] \text{ modulo } 360°\}\leqq 2\times PH_\text{Error Than Delta}_HC=-dHC$$

End the FOR loop.

Notice that ABS(phase) is used as defined at the beginning of sub-step (iii) of Step (c).

If there is no case that fulfill [1] or [2], Delta_HC may be greater than Maximum_Delta_HC, or there is a measurement error, or the input image was not stable during sub-steps (i) or (ii) of step (c). It might also be the result of incorrect format detection that leads to a completely wrong phase locked loop (PLL) initial setting. For example, format detection of input resolution was 640×480, unfortunately the actual input was 720×480—both formats have the same Hsync and Vsync timing characteristics but different initial phase locked loop (PLL) division factor value.

At this point correct phase locked loop (PLL) division factor value by setting it to:

Set phase locked loop (PLL) division factor value=Hsync_cycle−Delta_HC, and go to sub-step (iv) of Step (c) to determine the phase value.

If there is more than one case that fulfills [1] or [2], (if the result of the search process is not unique) then the result of the search process is not unique, and there is adding additional transitional pixels according to sub-step (i) of step (c), finding break point phase values of the additional pixels according to sub-step (ii) of step (c), and then repeating sub-step (2) of sub-step (iii).

To avoid these non-unique cases enter the following sub-step.

In sub-step (3) of sub-step (iii), there is checking uniqueness of the initial phase locked loop (PLL) division factor value.

To avoid the cases that the result of the previous sub-step search process is not unique, selection of transitional pixels found in sub-step (i) of step (c) of the algorithm should be checked.

$$-\text{Mark } dHC=ABS\ (\text{Delta}_HC)$$

The following two conditions, B1 and B2, check if two transitional pixels can distinguish between two error values of the initial phase locked loop (PLL) division factor values Delta_HC(1) and Delta_HC(2):

B1) A pair of transitional pixels Pi(xi , yi) and Pj(xj, yj), with horizontal difference dxij=xi−xj (assuming xi>xj) can distinguish between +dHC(1) and +dHC(2) and also between −dHC(1) and −dHC(2) if the ratio of dxij_corrected to stripe_width is not the same for dHC(1) and dHC(2). In formal writing:

$$ABS\{[dx_{ij}_\text{corrected}(1)/\text{stripe_distance}(1)]-[dx_{ij}_\text{corrected}(2)/\text{stripe_distance}(2)]\}<2\times PH_\text{Error}/360° \quad [8]$$

B2) A pair of transitional pixels Pi($x_i$, $y_i$) and Pj($x_j$, yj), with horizontal difference $dx_{ij}=x_i-x_j$ (assuming $x_i>x_j$) can distinguish between +dHC(1) and −dHC(2) and also between −dHC(1) and +dHC(2) if the sum of both ratio of $dx_{ij}$_corrected to stripe_width is not equal to 1. In formal writing:

$$ABS\{[dx_{ij}_\text{corrected}(1)/\text{stripe_distance}(1)]+[dx_{ij}_\text{corrected}(2)/\text{stripe_distance}(2)]-1\}<2\times PH_\text{Error}/360° \quad [9]$$

In equations [8] and [9], the break point phase error value (PH_Error) is taken into account. Twice that value is required because the error values for Pi and Pj may be of different signs.

Sub-step summary: for avoiding multiple matches when dHC=ABS(Delta_HC) is in the range of 1 to Maximum_Delta_HC, every pair of dHC(1) and dHC(2), in the range of 1 to Maximum_Delta_HC should be checked that there is at least one pair of transitional pixels that equation [8] holds, and at least one pair of transitional pixels that equation [9] holds.

In sub-step (iv) of Step (c), there is fine tuning the phase value of the sampling clock (Rx clock).

This step assumes that the error value of the initial phase locked loop (PLL) division factor value was fine tuned, or corrected, in sub-step (iii) of Step (c) such that the receiver sampling clock (Rx clock) frequency is exactly the same as the transmitter clock (Tx clock) frequency. The purpose of this step is to adjust Rx clock phase to the required value for sampling by the ADC the incoming pixels at the optimal sampling period. IF Delta_HC is equal to zero, there is continuing with sub-step (1) of sub-step (iv). If Delta_HC is not equals to zero, there is continuing with sub-step (2) of sub-step (iv).

In sub-step (1) of sub-step (iv), there is fine tuning the phase value of the sampling clock (Rx clock), when the error value of the phase locked loop (PLL) division factor value equals zero.

All transitional pixels break point measured phase (marked PHi) have theoretically the same values, with absolute phase difference of zero between each pair of transitional pixels. However, due to measured error value (PH_Error), the maximum absolute phase difference dPHij as was defined in sub-step (iii) of Step (c) is limited to 2×PH_Error.

The average value for break point phase is defined as Average (PHi). The phase margin that bring the sampling point to the center of the optimal sampling period (See FIG. 2) has to be subtracted from Average (PHi). Phase margin is about half of the optimal sampling period.

Therefore, if Delta_HC=0, the phase should be set to:

$$\text{Set Phase}=\{[\text{Average}(PHi)]-\text{Phase_Margin}\}\ \text{Modulo}\ 360°,\ i=0,1,2,\ldots,T \quad [3]$$

Definition of Average (PHi): The phase value is a circular unit, meaning that phase value of 0° and phase value of 360° refer to sampled pixels located at the same relative position. This fact should be taken into account when calculating the Average (PHi) of several phases (and it is also true for other group operators like Min, Max or Median).

For example:

Average (40°, 50°, 60°)=50°,

Average (350°, 10°, 20°)=(350+370+380)/3=367°=7°.

Instead of Average (PHi) filter operator, another type of filter may be used, for example, a median filter. The median filter arranges the input phase values in incremental order, and selects as an output the value of the center positioned value. For example: Median (355°, 0°, 30°)=0°

Phase_Margin: The phase to subtract from the break point phase for final phase locked loop (PLL) phase setting. Subtracting this value from the break point phase value places the ADC sampling point at the center of pixel optimal sampling period as shown in FIG. 2.

The Phase margin is found from the transitional time 20 (FIG. 2) of a transitional pixel using the following formula:

$$\text{Phase_Margin}=0.5\times 360°\times(1-(\text{transition time}/\text{pixel time}))$$

Jump to Step (d).

In sub-step (2) of sub-step (iv), there is fine tuning the phase locked loop (PLL) phase value, based on values of position ($x_i$) and phase (PHi) of the transitional pixels identified in sub-step (i) of Step (c), when the error value of the initial phase locked loop (PLL) division factor value is not equal to zero.

The division factor value Delta_HC may be corrected without performing this sub-step, followed by repeating sub-steps (i) to (iv) of Step (c). In this case, this sub-step is not required, because after the fine tuning, Delta_HC=0 and sub-step (1) of sub-step (iv) is used for correcting the phase. However, repeating sub-steps (i) to (iv) requires more processing time, because new measurements are needed for performing steps (i) and (ii), and a main aspect f the present invention is to search for and identify the phase value without needing to repeat measurements.

The definitions from sub-step (iii) of Step (c) are herein redefined for transitional pixels Pi instead of transitional pixel pairs (Pi,Pj) as follows:

Stripe_distance is defined as the horizontal distance in Rx clock cycles between two adjacent vertical noise stripes.

$$\text{Stripe_distance}=\text{Hsync_cycle}/ABS(\text{Delta_HC})$$

For each transitional pixels Pi, i=0 to T, xi_corrected is defined as follows:

$$x_i_\text{corrected}=x_i\ \text{modulo stripe_distance}$$

where the modulo function guarantee the result is in the range of 0 to stripe_distance−1.

Some observations are needed for this sub-step: as was written before, vertical noise stripes occur during sampling at the pixel transition. Moving the vertical stripe left or right can be done by changing the phase, which is the delay on the horizontal sync to the phase locked loop (PLL). Moving a stripe at the amount of one stripe distance requires a delay of exactly one Rx clock cycle, which is equal to 360°. Whenever Delta_HC is positive, increasing the phase value moves the stripes to the right. Whenever Delta_HC is negative, increasing the phase value moves the stripes to the left.

Changing phase locked loop (PLL) division factor value changes the number of stripes, but at all division factor values, the clock phase at the beginning of the line will remain unchanged because the phase locked loop (PLL) is locked at horizontal sync leading edge. Therefore the idea behind phase delay adjustment is to adjust correct phase at the beginning of the line, and this phase is going to be also the correct phase after correcting the error value of the initial phase locked loop (PLL) division factor value.

The phase delay is adjusted by moving the break point position to the beginning of the line by changing the phase value, and than subtracting Phase_Margin value to position the sampling point at the center of the optimal sampling period as showed in FIG. 2.

For each transitional pixel Pi, the algorithm determine the required phase value correction for moving the break point to the beginning of the line as follows:

If Delta_HC is positive, the phase value correction is done by subtracting (modulo 360°) from PHi the value of:

$$360°*(x_i_corrected/stripe_distance)=[360°*(x_i/stripe_distance)] \text{ modulo } 360°$$

If Delta_HC is negative, the phase value correction is done by adding (modulo 360°) to PHi the value of:

$$360°*(x_i_corrected/stripe_distance)=[360°*(x_i/stripe_distance)] \text{ modulo } 360°$$

The phase value correction should theoretically be the same value for each transitional pixel. However, due to error in PHi measure of ±PH_Error, the absolute phase difference between minimum and maximum correction is 2×PH_Error. An average or median function (as defined above) should be used to determining the final break point phase value correction.

As noted before, the final phase delay is set as follows:

Set Phase=(final break point phase correction—Phase_Margin) modulo 360°

The Phase delay setting formally written:

For each Transitional pixel Pi, in range 0 to T do:

IF Delta_HC>0THEN $$\text{Phase}(i)=[PHi-360°*(x_i/\text{stripe_distance})-\text{Phase_Margin}] \text{ modulo } 360° \quad [4]$$

IF Delta_HC<0 THEN $$\text{Phase}(i)=[PHi+360°*(x_i/\text{stripe_distance})-\text{Phase_Margin}] \text{ modulo } 360° \quad [5]$$

End of IF condition.

$$\text{Set Phase}=\text{Average}\{\text{Phase}(i)\},\ i=0 \text{ to } T \quad [6]$$

It is understood that other averaging function can be used instead of Average function. For example: median function. Both functions are defined in sub-step (1) of sub-step (iv).

In Step (d), there is sampling the received analog signals having digital information within the optimal sampling period.

Referring to FIG. 4, for correcting the initial sampling clock frequency error value, proportional to the error value of the initial phase locked loop (PLL) division factor value, the division factor error value determined in sub-step (iii) of step (c) above as Delta_HC is subtracted from the initial division factor value, Hsync_Cycle, and is feed into the Clock Divider 62 as the Division Factor 64. The corrected value of the phase of the sampling clock (Rx clock) of the digital synchronization signals, determined above as Set Phase in sub-step (iv) of step (c), is feed into the Phase Delay 50 as the Rx clock phase 52.

After feeding the phase locked loop (PLL) with the correct frequency and phase, the analog to digital converter (ADC) is sampling the incoming analog signals having digital information within the optimal sampling period 24 (FIG. 2). In a preferred embodiment of the present invention, the sampled digital information contains digital image pixels information. The digital image pixels information is transmitted to a digital display device for displaying the image.

In Step (e), there is receiving and displaying the digital image pixel information by a digital display device.

The received digital image pixels information were sampled at the optimal sampling period 24 (FIG. 2) and therefore the digital display device should be able to display the received digital image pixels information optimally.

Figure 6:
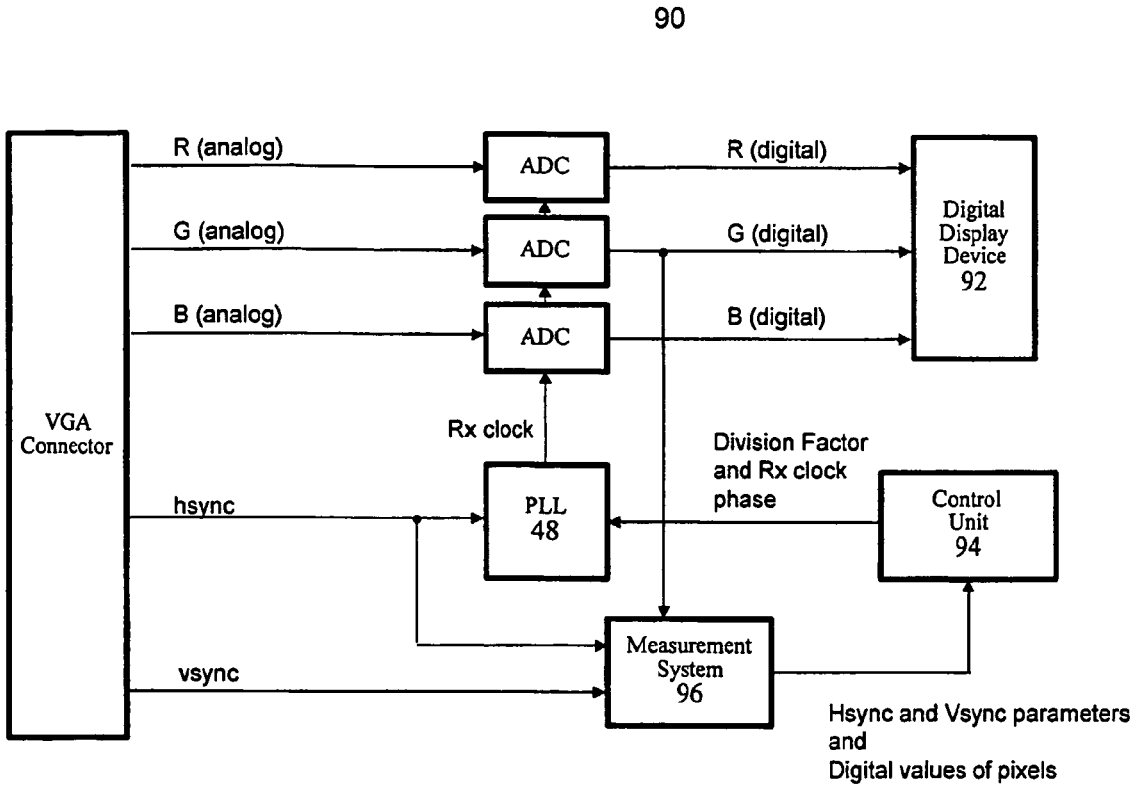
FIG. 6 is a block diagram illustrating an exemplary preferred embodiment of the system for fine tuning a sampling clock of analog signals having digital information for optimal digital display, in accordance with the present invention.

FIG. 6 is a block diagram illustrating an exemplary preferred embodiment of the system, generally referred to as system 90, for fine tuning a sampling clock of analog signals having digital information for optimal digital display, in accordance with the above described method of Step (a) through (e). In FIG. 6, measurement system 96 is used for implementing previously described Step (a), of receiving digital synchronization signals of the analog signals and detecting the format based on the received digital synchronization signals. Control unit 94 is used for implementing previously described Step (b) of is setting an initial frequency value of the sampling clock (Rx clock) by setting a phase locked loop (PLL) division factor value equal to Hsync cycle based on the detected format, and setting a phase value of the sampling clock (Rx clock), at a phase locked loop (PLL) mechanism, and implementing previously described Step (c) of fine tuning the frequency value of the sampling clock (Rx clock), by fine tuning the phase locked loop (PLL) division factor value, and fine tuning the phase value of the sampling clock (Rx clock), for synchronizing the phase locked loop (PLL) mechanism with an optimal sampling period. Digital display device 92 is used for implementing previously described Step (e). PLL 48 corresponds to phase locked loop (PLL) mechanism 48 illustrated in previously described FIG. 4. The analog signals are sampled during the optimal sampling period by the ADC devices shown in system 90 of FIG. 6.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention.

While the invention has been described in conjunction with specific embodiments and examples thereof, it is evident that many alternatives, modifications and variations will be apparent to those skilled in the art. Accordingly, it is intended to embrace all such alternatives, modifications and variations that fall within the spirit and broad scope of the appended claims.

What is claimed is:

1. A method comprising:

(a) receiving digital synchronization signals of analog signals having digital information for digital display and detecting format based on said received digital synchronization signals;

(b) setting an initial frequency value of a sampling clock of said analog signals by setting a phase locked loop division factor value equal to a digital horizontal synchronization signal cycle based on said detected format, and setting a phase value of the sampling clock at a phase locked loop mechanism;

(c) fine tuning said initial frequency value of the sampling clock by fine tuning said phase locked loop division factor value, and fine tuning said phase value of the sampling clock, for synchronizing said phase locked loop mechanism with a sampling period;

determining an error value of said phase locked loop division factor value, said error value being a difference between an actual said phase locked loop division factor value and a said phase locked loop division factor value matching said initial frequency value of the sampling clock to a frequency value of a transmitter timing clock;

(d) sampling said received analog signals having digital information within said sampling period; and (e) receiving and displaying said digital image pixel information by a digital display device.

2. The method of claim 1, whereby said digital synchronization signals are vertical sync and horizontal sync.

3. The method of claim 2, whereby said detecting said format is performed by measuring values of various parameters of said vertical sync and said horizontal sync signals, and comparing said measured parameter values to corresponding parameter values of known transmission formats stored in a database.

4. The method of claim 2, whereby said fine tuning of said phase value of the sampling clock is realized using a phase delay of said horizontal sync at said phase locked loop mechanism.

5. The method of claim 1, whereby said detecting said format is performed by knowing said format a priori.

6. The method of claim 1, whereby said phase locked loop mechanism used for generating the sampling clock is selected from the group consisting of (i) a phase locked loop hardware mechanism, featuring operation of a plurality of hardware components and elements, (ii) a phase locked loop software mechanism, featuring operation or execution of a plurality of software computer programs of software instructions or protocols using a suitable computer operating system, and, (iii) an operative combination of (i) and (ii).

7. The method of claim 1, whereby said optimal sampling period is at center of a stable pixel time, given by deducting from a pixel cycle time a pixel transition time and twice a phase jitter of the sampling clock.

8. The method of claim 1, whereby step (c) comprises the step of:

(i) searching for and identifying transitional pixels within an input image of the analog signals, and determining a phase value at which a pixel break point occurs for each said transitional pixel.

9. The method of claim 8, whereby said break point of each said transitional pixel defines a singular point within said pixel, having a phase value where value of said pixel starts to change from a stable region of preceding pixel in same horizontal line to a transitional region of said pixel.

10. The method of claim 9, whereby said break point phase value of said pixel value is measured while said phase value is swept to get a curve of said pixel value as a function of said phase value.

11. The method of claim 10, whereby step (c) further comprises the step of:

(ii) searching for and identifying a said phase value of a said break point for each said identified transitional pixel of the input image, by sweeping said phase values of the analog signals.

12. The method of claim 1, whereby if there is no unique solution to a said error value of said phase locked loop division factor value, there is searching for and identifying additional said transitional pixels.

13. The method of claim 1, whereby step (iii) comprises the step of:

(1) checking if said error value of said phase locked loop division factor value equals zero, whereby if said phase locked loop division factor value equals zero, there is determining a corrected value of said phase value of the sampling clock.

14. The method of claim 13, whereby step (iii) further comprises the step of:

(2) searching for and identifying said error value of said phase locked loop division factor value by searching through an entire range of allowed said error values.

15. The method of claim 14, whereby step (iii) further comprises the step of:

(3) checking uniqueness of a said phase locked loop division factor value.

16. The method of claim 15, whereby step (c) further comprises the step of:

(iv) fine tuning said phase value of the sampling clock, if said error value of said phase locked loop division factor value equals zero, and if said error value of said phase locked loop division factor value is not equal to zero, there is fine tuning said phase locked loop phase value based on values of position and phase of said identified transitional pixels.

17. A method comprising:

(a) receiving digital synchronization signals of analog signals having digital information for digital display and detecting format based on said received digital synchronization signals;

(b) setting an initial frequency value of a sampling clock of said analog signals by setting a phase locked loop division factor value equal to a digital horizontal synchronization signal cycle based on said detected format, and setting a phase value of the sampling clock at a phase locked loop mechanism;

(c) fine tuning said initial frequency value of the sampling clock by fine tuning said phase locked loop division factor value, and fine tuning said phase value of the sampling clock, for synchronizing said phase locked loop mechanism with a sampling period;

(i) searching for and identifying transitional pixels within an input image of the analog signals, and determining a phase value at which a pixel break point occurs for each said transitional pixel;

(ii) searching for and identifying a said phase value of a said break point for each said identified transitional pixel of the input image, by sweeping said phase values of the analog signals; and (iii) determining an error value of said phase locked loop division factor value, said error value being a difference between an actual said phase locked loop division factor value and a said phase locked loop division factor value matching said initial frequency value of the sampling clock to a frequency value of a transmitter timing clock;

(d) sampling said received analog signals having digital information within said sampling period; and (e) receiving and displaying said digital image pixel information by a digital display device.

18. The method of claim 17, whereby step (c) comprises the step of:

(i) searching for and identifying transitional pixels within an input image of the analog signals, and determining a phase value at which a pixel break point occurs for each said transitional pixel.

19. The method of claim 18, whereby said break point phase value of said pixel value is measured while said phase value is swept to get a curve of said pixel value as a function of said phase value.

* * * * *